United States Patent [19]

Riley

[11] Patent Number: 4,770,272

[45] Date of Patent: Sep. 13, 1988

[54] SAFETY ATTACHMENT FOR LADDER

[76] Inventor: Jon D. Riley, 159 Hill Dr., Vallejo, Calif. 94590

[21] Appl. No.: 83,592

[22] Filed: Aug. 6, 1987

[51] Int. Cl.[4] ..... E06C 7/18

[52] U.S. Cl. ..... 182/106; 182/121; 248/210

[58] Field of Search ..... 182/121, 122, 106, 214, 182/45, 56, 223; 248/238, 210

[56] References Cited

U.S. PATENT DOCUMENTS

| | | | |
|---|---|---|---|
| 524,661 | 8/1894 | Austin | 182/45 |
| 711,384 | 10/1902 | Carman | 182/141 |
| 1,088,525 | 2/1914 | Bottjer | 182/56 |
| 2,080,015 | 5/1937 | Sneddon | 182/106 |
| 2,381,812 | 8/1945 | Elwood | 182/106 |
| 2,656,223 | 10/1953 | Gray | 182/223 |
| 3,792,750 | 2/1974 | Madison | 182/121 |
| 4,425,985 | 1/1984 | Geisel | 182/121 |
| 4,515,242 | 5/1985 | La Chance | 182/106 |
| 4,548,293 | 10/1985 | Haab | 182/106 |

*Primary Examiner*—Reinaldo P. Machado
*Attorney, Agent, or Firm*—Townsend and Townsend

[57] ABSTRACT

A safety attachment for a ladder to permit the user of the attachment, when it is on the ladder, to be locked onto the ladder so that the user will be more positively connected to the ladder. The attachment includes a frame having hooks for removably coupling the frame to the rungs of a ladder. The frame has a pair of spaced cross-pieces or rods which allow one leg of the user to extend partially about one of the rods while the foot or shin of the leg engages the other of the rods.

18 Claims, 2 Drawing Sheets

FIG. 4
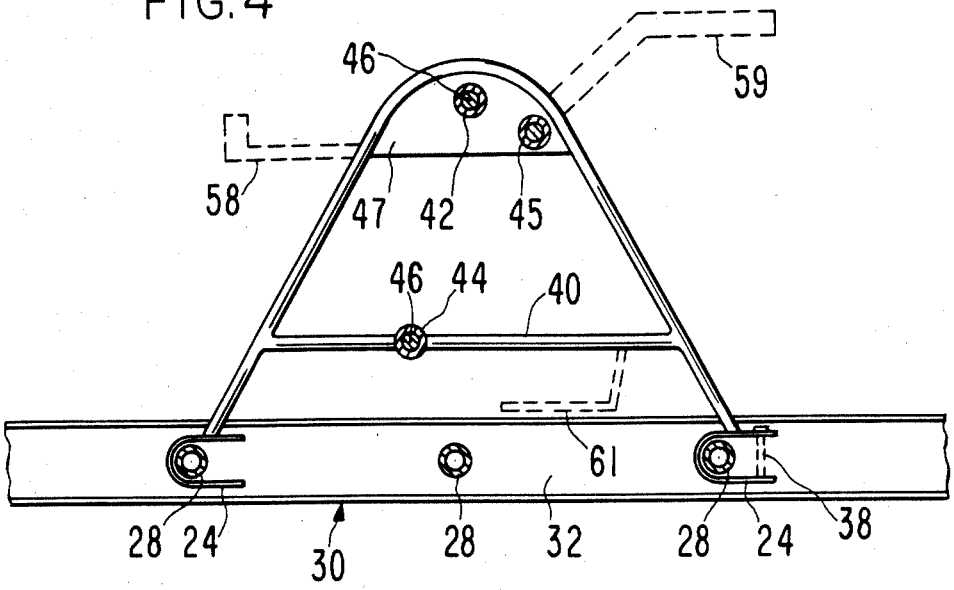
FIG. 5
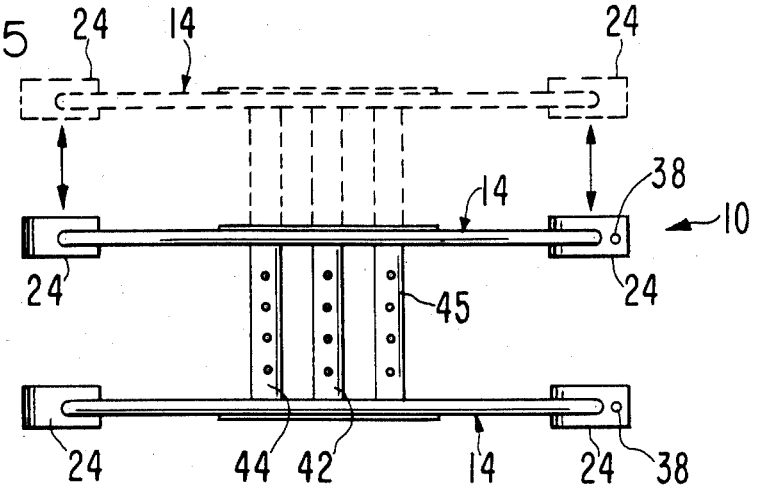
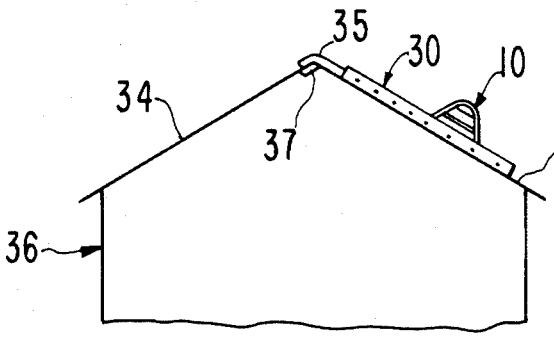
FIG. 1A

SAFETY ATTACHMENT FOR LADDER

This invention relates to improvements in safety features for ladders and, more particularly, to an attachment for a ladder to allow a person to work more safely on a pitched roof of a building structure.

BACKGROUND OF THE INVENTION

When firemen fight fires, they must oftentimes go onto a roof and cut holes into the roof for ventilation. To achieve this, a fireman uses a roof ladder with hooks which attach over the ridge board on the top of the roof to allow the fireman to climb up the pitched roof. The fireman must take a chain saw or an axe up the ladder so as to be able to cut a hole in the roof while standing on the rungs of the ladder while the ladder lies flat along the upper surface of the roof. This is a tedious and dangerous procedure which will cause serious injury to the fireman if he should slip and fall while standing on the ladder and trying to cut a hole in the roof, either with a chain saw or with an axe.

Because of the drawbacks associated with this procedure, a need exists for improvements in the way in which a fireman faced with a situation of the type described can be more safely locked onto the ladder while performing the jobs which are required, such as cutting a hole in the roof with a chain saw or an axe. The present invention satisfies this need as hereinafter described.

Prior art in this field of safety attachments for ladders include U.S. Pat. No. 2,381,812 which shows an attachment for the ladder of a fire truck. The attachment is to be mounted on the upper end of the ladder to provide a coupling for the upper end of a chute. By securing the upper end of the chute to the attachment, the chute can provide a means for evacuating persons from a multi-high storied building.

SUMMARY OF THE INVENTION

The present invention is directed to a safety attachment for a ladder to permit the user of the attachment, when it is on the ladder, to be locked onto the ladder so that the user will be more positively connected to the ladder. The attachment also permits the person to move laterally of the ladder while the ladder is on a pitched roof so as to allow the person to perform certain tasks, such as cutting a hole in a roof with a chain saw or an axe to ventilate the roof when the roof is on fire.

To this end, the attachment of the present invention includes a frame having means thereon for removeably coupling the frame to the rungs of a ladder to which the attachment is to be coupled. The frame has a pair of cross-pieces or rods which are spaced apart sufficiently to allow one leg of the user to extend partially about one of the rods while the foot or shin of the leg engages the other of the rods. In this way, when the attachment is coupled to the rungs of the ladder, the user is effectively locked onto or anchored by the attachment so that the person can move laterally of the ladder to perform certain tasks while being confident that the attachment will not separate from the ladder.

The attachment is simple and rugged in construction, has no moving parts, and is made from lightweight material. Thus, the person using the attachment can carry it to the location at which it is to be attached to a ladder on a pitched roof and the attachment can be quickly and easily attached to the rungs of the ladder while the ladder is on the upper surface of a pitched roof.

While the attachment can be used effectively by fireman in the fighting of fires, it can also be used by other individuals whose jobs require that they be on a roof, such as television repairmen, electricians, telephone installers and the like. Furthermore, the attachment can be provided with improvements thereon, such as a carrier for supporting tools and the like on the attachment, a seat on the attachment for allowing a person using the attachment to sit down while performing certain tasks, and a frame which can be adjusted to accommodate ladders of different widths.

The primary object of the present invention is to provide an improved safety attachment for a ladder wherein the attachment has means for locking onto the rungs of the ladder while the ladder extends along the upper surface of a pitched roof so that the person using the attachment can lock onto the ladder and be able to perform certain tasks at the side of the ladder.

Another object of the present invention is to provide a safety attachment of the type described wherein the attachment is simple and rugged in construction, is lightweight and has no moving parts yet it can be quickly mounted on and taken off a ladder while the ladder is on a pitched roof.

Other objects of this invention will become apparent as the following specification progresses, reference being had to the accompanying drawings for an illustration of several embodiments of the invention.

IN THE DRAWINGS

FIG. 1 is a side elevation view of a first embodiment of the safety attachment for the present invention for use with a ladder;

FIG. 1*a* is a schematic view of a building, showing the way in which the safety attachment of the present invention is used with the ladder on the roof of the building;

FIG. 4 is a view similar to FIG. 1 but showing another embodiment of the safety attachment;

FIG. 5 is a top plan view of the embodiment of FIG. 4, showing the way in which the attachment can be adjustable in width to accommodate different ladders.

Figure 1:
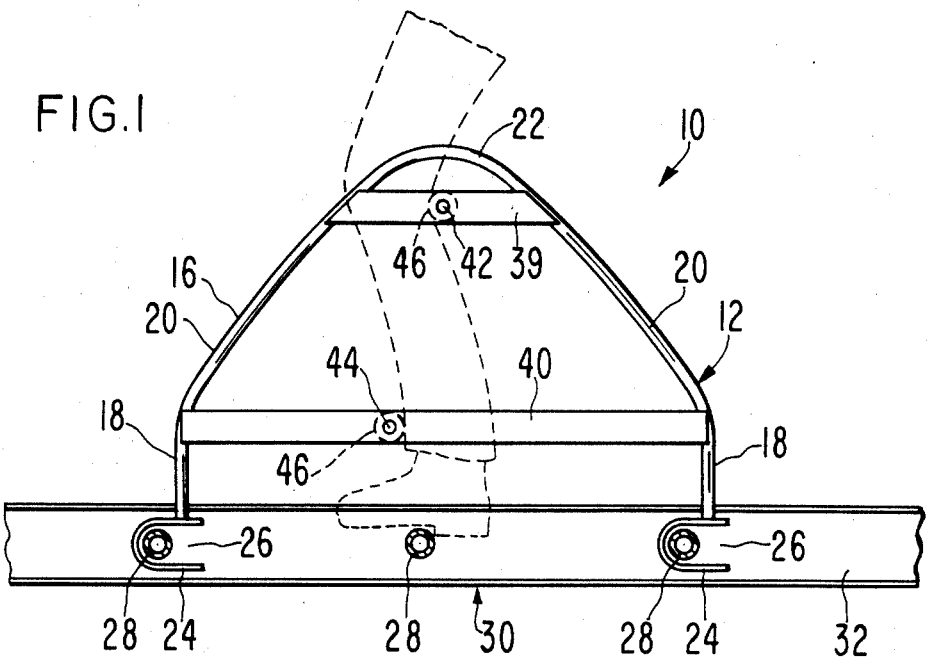
Figure 2:
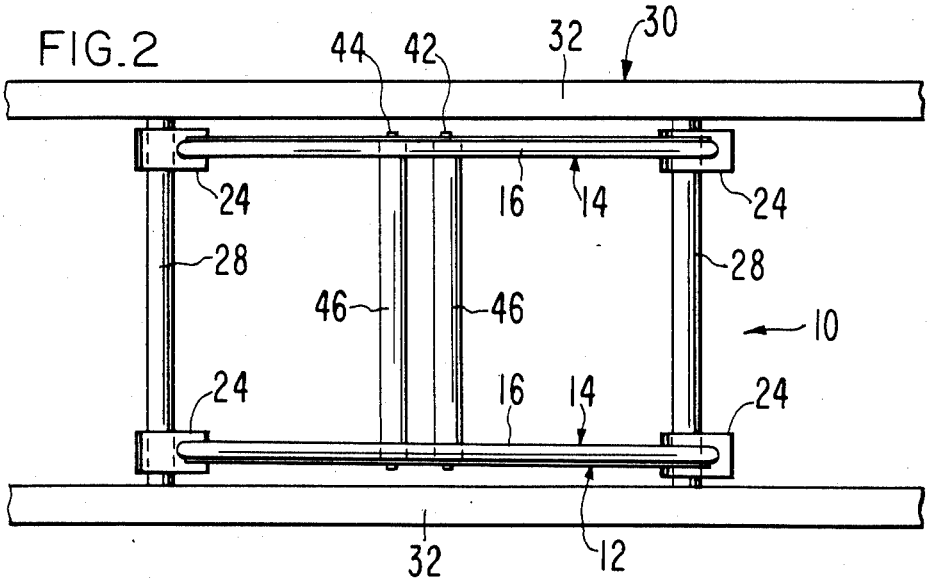
FIG. 2 is a top plan view of the safety attachment on the ladder.
Figure 3:
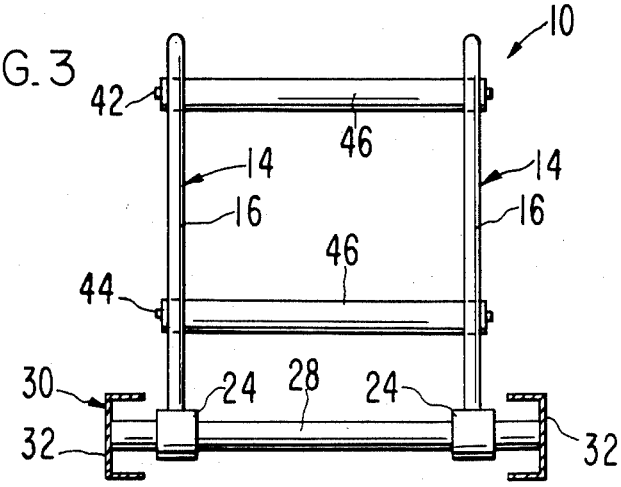
FIG. 3 is a front elevation view of the safety attachment.

The safety attachment of the present invention is broadly denoted in the first embodiment by number 10 and is shown in FIGS. 1–3. Safety attachment 10 includes a frame 12 having a pair of opposed, generally parallel sides 14 which are substantially identical in construction. For instance, each side 14 is comprised of rigid tube 16 such as of aluminum, Fiberglas, plastic or any other light weight material chosen also for strength purposes. Each tube 16 has a pair of lower segments 18 (FIG. 1), a pair of inclined segments 20 and a curved segment 22 which interconnects the upper ends of segments 20. Thus, segments 18, 20 and 22 are all integral with each other and form a one-piece pipe.

For each segment 18, a generally C-shaped hook 24 is rigidly secured. Each hook 24 has an open rear end 26 for receiving an adjacent rung 28 of a ladder 30 having a pair of side rails 32 as shown in FIGS. 2 and 3. Hooks 24 can be rigidly secured in any suitable manner, such as by welding or the like to the lower ends of segments 18, and the spacing between the hooks is such as to permit a pair of spaced rungs 28 to be received in the hooks in a manner shown in FIG. 1 to couple attachment 10 to the ladder. For purposes of illustration, spacing between each pair of adjacent rungs 28 is 14 inches; thus, for the particular configuration of attachment 10 shown in FIG. 1, the distance between hooks 24 is about 28 inches.

Generally, when attachment 10 is used with ladder 30, the ladder will be on a pitched roof 34 of a building 36 (FIG. 1A) so that the open ends 26 of hooks 24 will be at rear of the hooks to permit the force of gravity to seat the hooks on rungs 28. In such a way, attachment 10 is positively connected to the ladder and the attachment cannot be separated from the ladder except by movement of the attachment to the left when viewing FIG. 1, relative to the ladder itself. Ladder 10 is typically held flat against roof 34 by a hook 35 attached on the ridge board 37 of the roof.

For further safety, a spring loaded pin 38 shown in dashed lines in FIG. 4 can be provided to releasably lock a rung 28 in the interior of each of at least the rear hooks 24. Thus, lifting of the pins would be required to allow clearance of the rungs and passage of the rungs out of the spaces interiorly of the hook.

Each side 14 has a pair of vertically spaced straps or bands 39 and 40 as shown in FIG. 1. The ends of band 39 are rigidly secured, such as by welding, to the upper ends of segments 20. The ends of band 40 are rigidly secured in any suitable manner, such as by welding, to the upper ends of segments 18. Bands 39 and 40 not only rigidly the respective sides 14 but they also serve as supports for the ends of a pair of vertically spaced, rigid rods 42 and 44 which span the distance between bands 39 and 40. Rod 42 is rigidly secured at its ends in any suitable manner to bands 39, and rod 44 is rigidly secured at its ends to bands 40. In this way, sides 14 are interconnected so as to cause attachment 10 to be essentially a one-piece unit with no moving parts. A cylindrical rubber padding element 46 surrounds each of rods 42 and 44, respectively, for cushioning purposes.

In use, attachment 10 is removably coupled to ladder 30 when the ladder is in any suitable manner, such as in an operative position on a pitched roof 34 of a building, such as building 36 (FIG. 1A). The upper end of the ladder is secured in any suitable manner such as by a hook 35 hooked over the ridge board 37 of the roof 34. In this way, the ladder is not movable upwardly and is held against downward movement by the hook 35. The user of attachment 10 then climbs to the lower end of the roof 34, such as by another ladder, and carries attachment 10 with him; whereupon the attachment is further carried upwardly along ladder 30 until a desired location is reached along the ladder for placement of the attachment and for coupling the attachment to the ladder. At such a location, hooks 24 are placed over adjacent rungs 28 and the attachment is allowed to move slightly rearwardly to seat the rungs in the hooks in the manner shown in FIG. 1.

With attachment 10 in place on the ladder as shown in FIGS. 1–3 and with the attachment being locked by pins 38 on the ladder, the user, when desiring to be anchored by attachment 10, places one leg over upper rod 42 and then places the shin part of the same leg against and behind rod 46 while the shoe or boot of the leg is supported on a rung 28. For instance, the leg will be the left leg if the user plans to perform certain acts at the right side of the ladder, whereupon the right leg will be supported on the roof part to the right of the ladder while the left leg will be anchored to attachment 10 by virtue of the fact that the upper rod 42 will be behind the knee and the lower rod 44 will be in front of the shin. This effectively supports the leg and thereby stabilize the body of the user for movements in a lateral direction since the attachment cannot be separated from the ladder except by being moved forwardly of the ladder after pins 38 have been lifted to unlocked positions. The user can then perform many different types of jobs, such as using an axe to chop a hole in the adjacent roof portion near the portion of the roof where his right leg is supported, assuming the left leg is the one anchored by attachment 10.

The attachment can be used by TV repairmen to erect, take down or to repair television antennas on a roof. The attachment can be used for any job which requires that the body of the user be stable and properly anchored in place while the user performs certain acts to one side of the ladder or the other side thereof. The attachment provides a greater range of mobility for the user while minimizing the fear of falling or separation from the ladder. Thus, the user will have more confidence to perform a particular job more quickly and effectively and with greater safety.

At the end of the use of the attachment, the leg is unlocked or separated from the attachment, whereupon the attachment is moved forwardly to cause hooks 24 to move off the rungs 28. Then, the attachment can be safely and easily carried down the ladder and the ladder can be removed from the roof in the normal fashion.

Attachment 10 can be made so that it is adjustable in width in the manner shown in FIGS. 4 and 5. To this end, each of rods 42 and 44 is made of two pieces which are relatively telescoped to permit shortening or lengthening the rods as shown in FIG. 5. Set screws can be used to releasably hold the rods in fixed positions. An additional rod 45 is provided to permit a second person to hold onto attachment 10 when the second person needs to be on ladder 30.

Attachment 10 can be provided with other features if desired. For instance, attachment 10 can be provided with a tool receiving platform 55 (FIG. 4) which can be removably or otherwise fixedly secured to attachment 10 near the upper end thereof so that the user of the attachment can be close enough to the tools on carrier 55 so as to be able to use the tools while being locked onto or anchored by attachment 10.

Attachment 10 can be adjustable in height, if desired, such as by adjusting the length of each of the segments 18 of each side 14 of attachment 10. Attachment 10 can be adjusted in length by making each of straps or bands 39 and 40 of two pieces which are movable relative to each other. A seat 59 can be releasably or fixedly attached to attachment 10 at any suitable location, such as rearwardly of upper rod 42 to permit the user to sit down at intervals or while performing certain tasks, such as painting or other jobs. A platform 61 could be provided on the bottom of the attachment, such as at a location indicated by numeral 61. This will permit the user to stand on the platform for painting or other jobs which do not require that the leg be locked onto rods 42 and 44. Moreover, hooks 24 can be replaced by other fasteners to accommodate ladders with flat steps. A pulley system can be used on attachment 10 to pull up tools or whatever with or without a guard rail.

I claim:

1. A safety attachment for use with a ladder having a plurality of spaced rungs when the ladder extends along and is in engagement with a surface extending transverse to the vertical comprising:

a frame having means thereon for removably coupling the frame to at least a pair of the rungs of the ladder with the frame having a part extending outwardly from the ladder; and a pair of rods carried by the frame part at spaced locations thereon for locking the leg of the user on the ladder, the spacing between the rods and the distance between each rod and an adjacent rung of the ladder being sufficient to permit one of the rods to engage the foot or the leg near the foot of the user and the other rod to engage the leg near the back of the knee whereby the user can lock a leg to the frame and extend laterally of the ladder while remaining locked to the frame when the frame is coupled to the ladder.

2. A safety attachment as set forth in claim 1, wherein the rods are parallel with the rungs of the ladder when the frame is coupled to the ladder.

3. A safety attachment as set forth in claim 1, wherein said frame includes a pair of spaced sides.

4. A safety attachment as set forth in claim 3, wherein each side includes a rigid member having a pair of normally lower ends, said coupling means being on the ends of each member, respectively.

5. A safety attachment as set forth in claim 4, wherein each member is comprised of a pair of lower segments, a pair of inclined intermediate segments, and a top segment, the segments being integral with each other, the coupling means being on the lower ends of the lower segments.

6. A safety attachment as set forth in claim 5, wherein is included a pair of elements interconnected the intermediate segments near the upper and lower ends thereof, said elements being coupled to the ends of respective rods.

7. A safety attachment as set forth in claim 1, wherein said coupling means includes a hook for each end, respectively, each hook having an open rear end to allow the hook to receive a respective rung of the ladder.

8. A safety attachment as set forth in claim 7, wherein is included means on each hook, respectively, to releasably holding a rung in the interior space of the hook.

9. A safety attachment as set forth in claim 8, wherein said holding means includes a spring biased pin.

10. A safety device as set forth in claim 1, wherein said frame has a pair of opposed spaced sides, said frame being adjustable in width.

11. A safety attachment as set forth in claim 1, wherein said locking means includes a pair of spaced rods adjustable in length to permit variations in the width of the frame.

12. A safety attachment as set forth in claim 11, wherein each rod is comprised of a pair or relatively telescoped parts, and means for rigidly securing the parts of each rod together in an operative position.

13. A safety attachment as set forth in claim 1, wherein said frame has a platform for use in carrying tools thereon.

14. A safety attachment as set forth in claim 1, wherein is included means for forming a seat on the frame near the outer part thereof.

15. A safety attachment as set forth in claim 1, wherein is included a platform near the lower end of the frame to allow the user to stand on the platform.

16. A safety attachment as set forth in claim 1, wherein is included a third rod generally parallel with the first and second rod for forming a hand-hold for another person on a ladder on which the frame is mounted.

17. In combination:

a ladder having a plurality of spaced rungs and adapted to extend along and to engage a surface extending transverse to the vertical;

a frame having means thereon for removably coupling the frame to at least a pair of the rungs of the ladder with the frame having a part extending outwardly from the ladder; and a pair of rods carried by the frame part at spaced locations thereon for locking the leg of the user on the ladder, the spacing between the rods and the distance between each rod and an adjacent rung of the ladder being sufficient to permit one of the rods to engage the foot or the leg near the foot and the other rod to engage the leg near the back of the knee, whereby the user can lock a leg to the frame and extend laterally of the ladder while remaining locked to the frame when the frame is coupled to the ladder.

18. A safety attachment as set forth in claim 17, wherein the rods are parallel with the rungs of the ladder when the frame is coupled to the ladder.

* * * * *